US006385957B2

(12) United States Patent
Misrachi

(10) Patent No.: US 6,385,957 B2
(45) Date of Patent: May 14, 2002

(54) WIRE ROPE WITH REVERSE JACKETED IWRC

(75) Inventor: Joseph Misrachi, Côte St-Luc (CA)

(73) Assignee: Wire Rope Industries Ltd., Montreal (CA)

( * ) Notice: Subject to any disclaimer, the term of this patent is extended or adjusted under 35 U.S.C. 154(b) by 0 days.

(21) Appl. No.: 09/779,572

(22) Filed: Feb. 9, 2001

(30) Foreign Application Priority Data

Feb. 28, 2000 (CA) ..... 2298945

(51) Int. Cl.[7] ..... D02G 3/36; D07B 1/06
(52) U.S. Cl. ..... 57/221; 57/214; 57/217
(58) Field of Search ..... 57/217, 214, 221, 57/223, 147, 145

(56) References Cited

U.S. PATENT DOCUMENTS

| | | | | | |
|---|---|---|---|---|---|
| 3,705,489 | A | * | 12/1972 | Smollinger | 57/139 |
| 3,824,777 | A | * | 7/1974 | Riggs | 57/149 |
| 4,120,145 | A | | 10/1978 | Chiappetta et al. | 57/149 |
| 4,125,741 | A | * | 11/1978 | Wahl et al. | 174/120 |
| 4,365,467 | A | * | 12/1982 | Pellow | 57/214 |
| 4,827,708 | A | * | 5/1989 | Verreet | 57/212 |
| 5,386,683 | A | | 2/1995 | Misrachi | 57/3 |

* cited by examiner

*Primary Examiner*—Andy Falik
(74) *Attorney, Agent, or Firm*—George J. Primak

(57) ABSTRACT

A wire rope is disclosed, which has at most 18 outer strands and an independent wire rope core, with the strands of the core being laid in the opposite direction to the outer strands of the rope, and a nylon jacket is provided between the core and the outer strands of the wire rope.

5 Claims, 1 Drawing Sheet

WIRE ROPE WITH REVERSE JACKETED IWRC

BACKGROUND OF THE INVENTION

1. Field of the Invention

This invention relates to a wire rope construction with reverse jacketed IWRC (independent wire rope core). More specifically it relates to such construction where the wire rope has no more than 18 outer strands and where the jacket consists of nylon.

2. Description of the Prior Art

Most wire ropes in the wire rope industry are designed so that outer rope strands are laid in the same direction as the strands of the core. For example, if the outer rope strands are laid to the left the same is done with the strands of the core. This is done so as to minimize contact loads between the two. In this manner the core strands do not deteriorate very quickly allowing the rope to fail first primarily from the outside. This allows users to count outer rope strands broken wires and use these as a retirement criteria for the rope. This method of making and inspecting ropes is standard in the industry and is a recognized method to use ropes in a safe manner.

Most of the ropes manufactured as described above will have a tendency to have their ends rotate under load. This is because all the strands of the rope want to straighten under load. Non-rotating ropes are a special category of ropes designed in such a way as to minimize or even prevent completely this rotation. These ropes are usually utilized in crane applications where it is not desirable to have the load rotate during lifting. The lifting end of the rope is always used unrestrained and free to rotate. If a conventional rope is used the rope will unlay, which is also undesirable.

Common designs used for these applications consist of multi strand ropes having the interior core strands laid in a direction which is opposite to the one of the outer rope strands. In these situations both the outer rope strands and the core strands want to unlay under load but they do it in opposite directions. It is a known fact in the industry that the larger the core diameter relative to the individual diameter of the outer rope strands, the better the antirotation properties of the rope. This is because the torque developed by the core can better counteract the torque developed by the outer strands of the rope.

There are three main categories of non-rotating ropes on the market: the 34–35 strand ropes with round and compacted strands; the 18 strand also with round and compacted strands; and finally there is also an eight strand, low cost and lower performance variety consisting of what is commonly known as 8 strand reverse IWRC rope.

The following list identifies these ropes from worst to better in relation to their anti-rotating properties.

Worst performance: 8 strand reverse IWRC rope

Intermediary performance: 18 strand non-rotating rope

Best performance: 34–35 strands non-rotating ropes.

The reason for this behaviour is quite simple: the core in the eight strand rope is the smallest of the three types described above so it does not counteract the torques of the outer strands as well as the larger cores of 18 strand, and particularly 34–35 strands. It should be noted that non-rotating wire ropes with 18 outer strands or less have generally unsatisfactory performance, with the worst cases being ropes of 8 strands or less.

Since the outer strands of these ropes cross-cut at approximately 90° angle, the outer strands of their respective cores, they usually exhibit a rapid, invisible core deterioration that cannot be detected from the outside. In other words the detection of outer broken wires cannot be used to assess the inner rope condition. This is particularly the case of 8 strands reverse IWRC ropes and also of 18 strands ropes, while this condition is less severe with the 34–35 strands ropes.

It is hence normal to retire ropes having 18 strands or less from operation after a fixed number of hours or cycles to avoid the "surprise" of a sudden internal failure. Another alternative is to jacket the core with plastic materials to prevent the abrasion taking place at the rope strand-core strand interface.

It is already known to provide a jacket of a thermoplastic material, such as polypropylene, around a lubricated core, as disclosed for example in U.S. Pat. No. 4,120,145.

Applicant's own U.S. Pat. No. 5,386,683 also discloses a jacketed core in which the plastic material of the jacket is identified as polyethylene, polypropylene, nylon or another suitable thermoplastic material.

However, none of the above prior art patents deal specifically with wire ropes of 18 outer strands or less that have reverse jacketed IWRC lay, since the applicant found that with such wire rope construction the commonly employed jacket of polypropylene produces essentially no improvement over the non-jacketed construction and is therefore unsatisfactory.

When reviewing the situation it became obvious that a conventional cushioned core solution and approach did not work in this case. The examination of the polypropylene jacket showed that it had perforated at all the contact points between the outer stands and the core. A conclusion was reached that when dealing, for example, with an 8 strand rope or an 18 strand rope of reverse IWRC lay, the compression load applied by the outer strands on the core would be higher than the compression load applied by the outer strands of a 34–35 strand rope. The same would apply to all such wire ropes of 18 outer strands or less, which must therefore be considered as a special category of non-rotating ropes to which the present invention applies.

SUMMARY OF THE INVENTION

The present invention resides in providing a nylon jacket in lieu of polypropylene jacket in wire ropes having at most 18 outer strands and a reverse IWRC lay. Despite the fact that nylon has been mentioned as a suitable jacket material in the past, it was always mentioned as a substitute or alternative material to polypropylene, performing essentially the same function. It is, therefore, surprising and unexpected that in the special category of wire ropes which are under consideration herein, nylon jacketing of the core acts very differently than that of polypropylene, providing essentially double the protection as will be shown later.

BRIEF DESCRIPTION OF THE DRAWINGS

The invention will now be described with reference to the appended drawings in which.

DETAILED DESCRIPTION OF THE INVENTION

The figures illustrate a preferred but non-limitative embodiment of the invention.

Figure 1:
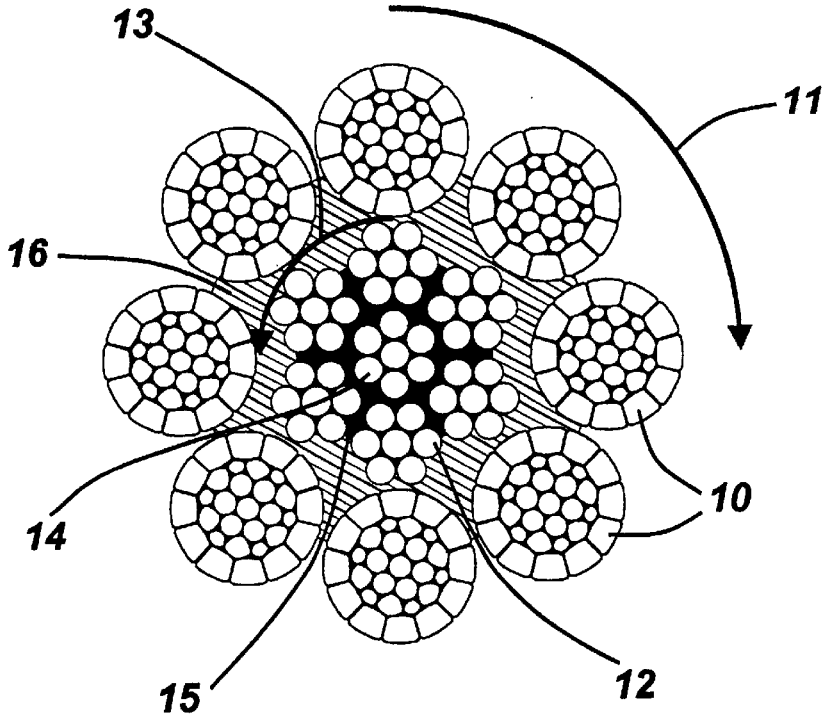
FIG. 1 shows a schematic cross-sectional view of a wire rope construction with a nylon jacket in accordance with the present invention.

FIG. 1 shows a ¾" (1.875 cm) 8×31 reverse core rope construction with eight outer strands 10, each having 31 wires. The IWRC core of the wire rope is formed of six strands 12 wound around a central strand 14. The core strands 12 are wound in the opposite direction to the outer strands 10 as shown by arrows 11 and 13. Arrow 11 indicates that the outer strands 10 of the rope are wound in the clockwise direction, while the outer strands 12 of the core are wound in the counter-clockwise direction. The core is also filled with an appropriate lubricant 15. Between the core strands 12 and the outer strands 10 there is provided an nylon jacket 16, which cushions the core against the pressure exerted by the outer stands 10 during application of the load.

The wire rope described above is produced as follows:

1. a core is produced by winding strands 12 over the central strand 14 in a predetermined direction (in this specific case with a left lay as shown by arrow 13);
2. the core is then filled with a suitable lubricant 15;
3. a nylon jacket 16 having in this case a thickness of 0.20" (0.5 cm) is then extruded onto the core; and finally
4. outer strands 10 (which are also normally lubricated) are wound onto the nylon jacket in the opposite direction to the core strands 12 (in this specific case with a right lay as shown by arrow 11), and compressed thereon so that the nylon from the jacket 16 penetrates between the interstices of the outer strands 10.

The above specific construction is used as a specific example and the various modifications can be made therein and in the method of its manufacture. For example, various sizes mentioned herein may be modified and adopted to the requirements of the user. Also, steps 2 and 3 of the method of manufacture mentioned above could be combined so that the core is impregnated and jacketed at the same time.

Figure 2:
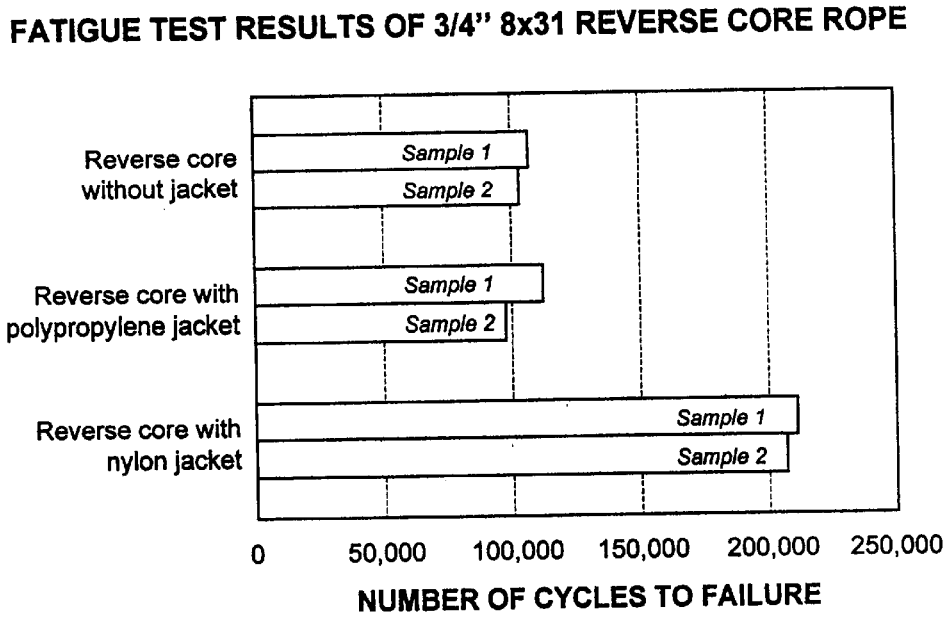
FIG. 2 is a graph showing fatigue test results comparing the wire rope of the present invention with similar ropes having no jacket or a polypropylene jacket.

FIG. 2 gives comparative results for the wire rope described above with reference to similar ropes produced without any jacket and with a polypropylene jacket of the same thickness.

Thus, the applicant first prepared a ¾" 8 strand reverse IWRC wire rope such as shown in FIG. 1, but without any jacket between the outer stands and the core. Two samples of such rope were subjected to a reverse bend fatigue test using a load of 1000 lbs (450 kg). As shown in FIG. 2, such non-jacketed rope failed after just over 100,000 cycles.

Then, to improve this result, a polypropylene jacket of 0.20" (0.5 cm) was used between the core and the outer strands. Surprisingly, this construction produced essentially no improvement, also as illustrated in FIG. 2.

Since polypropylene did not produce improved results one would normally have expected that nylon, which is often mentioned as an alternative to polypropylene in such cases, would also be inadequate. Applicant had used nylon in other circumstances where it was found to act in a manner similar to polypropylene. Applicant has, however, decided to try to use nylon in this particular case to see if it would enhance the performance. Two samples of the wire rope with a nylon jacket of 0.20" (0.5 cm), such as shown in FIG. 1, where thus subjected to the same fatigue tests as the previous samples. To applicant's surprise the number of cycles to failure essentially doubled with the nylon jacketed construction as compared to polypropylene jacketed or un-jacketed constructions. This unexpected result shows that nylon is a selected material of choice for such reverse core rope constructions.

The nylon jacket did not get perforated before the occurrence of outer rope strand degradation and failure of the wire rope due to such degradation. This was contrary to what happened with the polypropylene jacket which perforated very rapidly under load.

What is claimed is:

1. A wire rope having at most 18 outer strands and an independent wire rope core, with strands of the core being laid in opposite direction to the outer strands of the wire rope making such wire rope essentially non-rotating during application of a load, characterized in that a nylon jacket is provided between the outer strands and the core of said wire rope.

2. A wire rope according to claim 1, in which the nylon jacket has a thickness such as to substantially prevent perforations to occur in said jacket before occurrence of degradation of the outer stands of the wire rope.

3. A wire rope according to claim 1, in which the core is lubricated.

4. A wire rope according to claim 1, in which the outer strands of the rope crosscut the strands of the core at approximately 90° angle.

5. A wire rope according to claim 1, which is a rope with eight outer strands.

* * * * *